US008385808B2

(12) United States Patent
Bridges

(10) Patent No.: US 8,385,808 B2
(45) Date of Patent: Feb. 26, 2013

(54) METHOD AND APPARATUS FOR MANAGING MEDIA TRAYS IN AN IMAGE PRODUCTION DEVICE

(75) Inventor: Richard Bridges, London (GB)

(73) Assignee: Xerox Corporation, Norwalk, CT (US)

( * ) Notice: Subject to any disclaimer, the term of this patent is extended or adjusted under 35 U.S.C. 154(b) by 723 days.

(21) Appl. No.: 12/563,520

(22) Filed: Sep. 21, 2009

(65) Prior Publication Data

US 2011/0070009 A1 Mar. 24, 2011

(51) Int. Cl.
*G03G 15/00* (2006.01)
*B41J 29/02* (2006.01)

(52) U.S. Cl. ..... 399/405; 400/692; 399/370

(58) Field of Classification Search ..... 399/405, 399/376; 271/259; 400/692
See application file for complete search history.

(56) References Cited

U.S. PATENT DOCUMENTS 6,512,599 B1 * 1/2003 Hattori ..... 358/442
2007/0092280 A1 * 4/2007 Nakazato et al. ..... 399/75
2007/0286615 A1 * 12/2007 Watanabe ..... 399/21
2008/0101843 A1 * 5/2008 Murahashi et al. ..... 400/708
2009/0074430 A1 * 3/2009 Nakazato et al. ..... 399/13
2010/0021202 A1 * 1/2010 Okano ..... 399/114

* cited by examiner

*Primary Examiner* — Daniel J Colilla
*Assistant Examiner* — Allister Primo
(74) *Attorney, Agent, or Firm* — Ronald E. Prass, Jr.; Prass, LLP

(57) ABSTRACT

A method and apparatus for managing media trays in an image production device is disclosed that may include determining if a media tray door is open, and if so, starting a timer, determining if a misfeed indication has been set, and if so, determining if the timer has reached a first predetermined value, and if it has not, determining if the media tray door has been closed, and if so, returning the image production device to a pre-media tray opening state. Otherwise, if it is determined that a misfeed indication has been set, determining if the timer has reached a second predetermined value, and if it has not, determining if the media tray door has been closed, and if so, returning the image production device to the pre-media tray opening state.

21 Claims, 3 Drawing Sheets

METHOD AND APPARATUS FOR MANAGING MEDIA TRAYS IN AN IMAGE PRODUCTION DEVICE

BACKGROUND

Disclosed herein is a method for managing media trays in an image production device, as well as corresponding apparatus and computer-readable medium.

To ensure that an image production device knows the size, type/weight, and color of media loaded in an adjustable tray, a user is requested to confirm the media information every time a tray is closed. This process gives the image production device the information it requires to make system adjustments for specific media criteria. However, the process also requires that a user make this confirmation every time a tray is closed regardless of whether additional media has been loaded, such as during a paper jam scenario or if the user wishes to open a media tray door and perform a quick check. Accordingly, the user must endure delays and be required to perform unnecessary or redundant steps to put the machine back in operation.

SUMMARY

The disclosed embodiments may include a method for managing media trays in an image production device. The method may include determining if a media tray door is open, wherein if it is determined that the media tray door is open, starting a timer, determining if a misfeed indication has been set, wherein if it is determined that a misfeed indication has not been set, determining if the timer has reached a first predetermined value, wherein if it is determined that the timer has not reached the first predetermined value, determining if the media tray door has been closed, wherein if it is determined that the media tray door has been closed, returning the image production device to a pre-media tray opening state, otherwise if it is determined that a misfeed indication has been set, determining if the timer has reached a second predetermined value, wherein if it is determined that the timer has not reached the second predetermined value, determining if the media tray door has been closed, wherein if it is determined that the media tray door has been closed, returning the image production device to the pre-media tray opening state.

DETAILED DESCRIPTION

Figure 1:
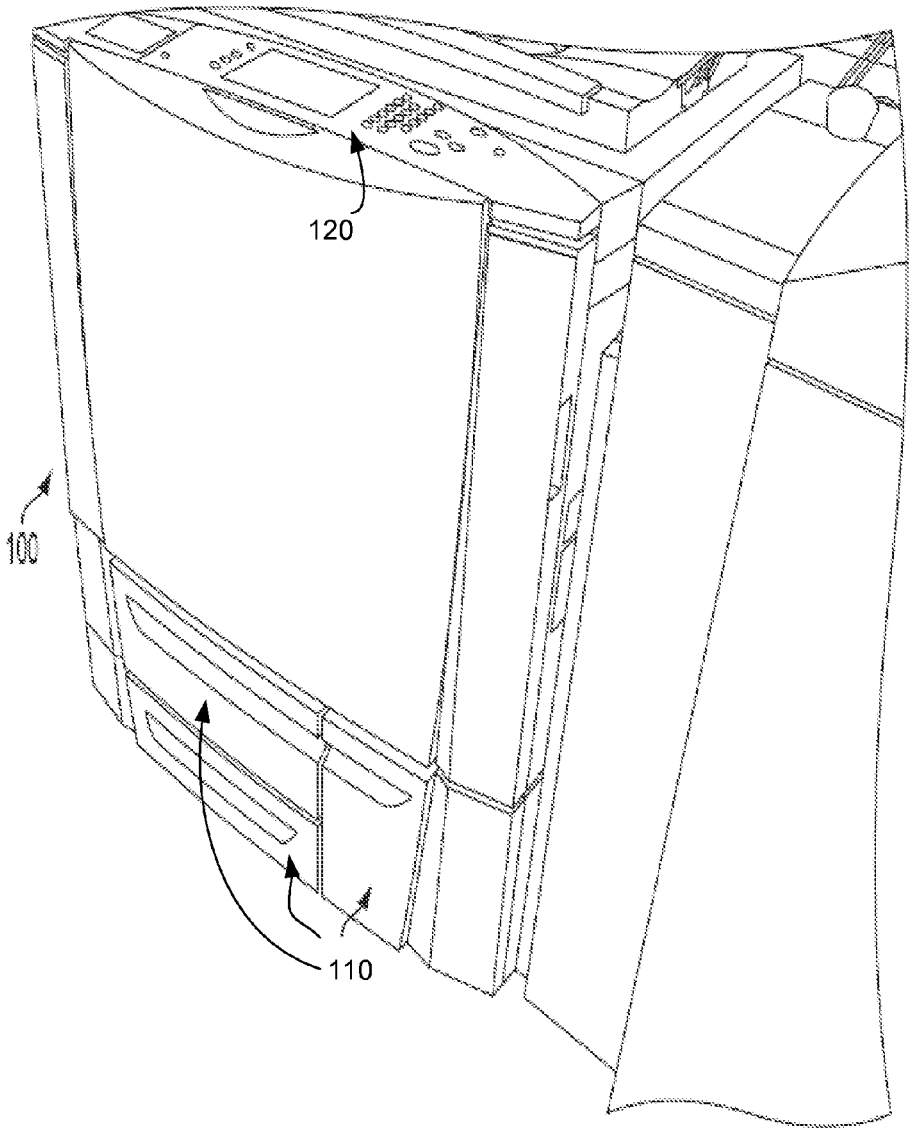
FIG. 1 is an exemplary diagram of an image production device in accordance with one possible embodiment of the disclosure.

Aspects of the embodiments disclosed herein relate to a method for managing media trays in an image production device, as well as corresponding apparatus and computer-readable medium.

The disclosed embodiments may include a method for managing media trays in an image production device. The method may include determining if a media tray door is open, wherein if it is determined that the media tray door is open, starting a timer, determining if a misfeed indication has been set, wherein if it is determined that a misfeed indication has not been set, determining if the timer has reached a first predetermined value, wherein if it is determined that the timer has not reached the first predetermined value, determining if the media tray door has been closed, wherein if it is determined that the media tray door has been closed, returning the image production device to a pre-media tray opening state, otherwise if it is determined that a misfeed indication has been set, determining if the timer has reached a second predetermined value, wherein if it is determined that the timer has not reached the second predetermined value, determining if the media tray door has been closed, wherein if it is determined that the media tray door has been closed, returning the image production device to the pre-media tray opening state.

The disclosed embodiments may further include an image production device that may include one or more media tray doors that provide access to media trays and may be opened by a user, one or more media tray door sensors that sense whether the one or more media tray door is at least one of open and closed, a timer, and a media tray management unit that determines if at least one of the one or more media tray doors is open, wherein if the media tray management unit determines that at least one of the one or more media tray doors is open, the media tray management unit starts the timer, determines if a misfeed indication has been set, wherein if the media tray management unit determines that a misfeed indication has not been set, the media tray management unit determines if the timer has reached a first predetermined value, wherein if the media tray management unit determines that the timer has not reached the first predetermined value, the media tray management unit determines if the at least one media tray door has been closed, wherein if the media tray management unit determines that the at least one media tray door has been closed, the media tray management unit returns the image production device to a pre-media tray opening state, otherwise if the media tray management unit determines that a misfeed indication has been set, the media tray management unit determines if the timer has reached a second predetermined value, wherein if the media tray management unit determines that the timer has not reached the second predetermined value, the media tray management unit determines if the at least one media tray door has been closed, wherein if the media tray management unit determines that the at least one media tray door has been closed, the media tray management unit returns the image production device to the pre-media tray opening state.

The disclosed embodiments may further include a computer-readable medium storing instructions for controlling a computing device for managing media trays in an image production device. The instructions may include determining if a media tray door is open, wherein if it is determined that the media tray door is open, starting a timer, determining if a misfeed indication has been set, wherein if it is determined that a misfeed indication has not been set, determining if the timer has reached a first predetermined value, wherein if it is determined that the timer has not reached the first predetermined value, determining if the media tray door has been closed, wherein if it is determined that the media tray door has been closed, returning the image production device to a pre-media tray opening state, otherwise if it is determined that a misfeed indication has been set, determining if the timer has reached a second predetermined value, wherein if it is determined that the timer has not reached the second predetermined value, determining if the media tray door has been closed, wherein if it is determined that the media tray door has been closed, returning the image production device to the pre-media tray opening state.

The disclosed embodiments concern managing media trays in an image production device. The process addresses scenarios where media trays and doors are accessed for reasons other than paper replenishment. For example, a user may open media tray doors, such as those containing 8.5×11, 8.5×14, A3, A4 and A5 adjustable trays in an image processing device to load media, to check the quantity of media loaded in the tray, to check the size, type/weight or color of the media in a tray, to clear a miss-feed, etc.

Under the process of the disclosed embodiments, if an adjustable tray is opened and closed within a specific time limit and the size sensing switches return the same size region once the tray is closed as before the tray was opened, the system may assume that the media in the tray has not changed. A proposed time limit may be 0-15 seconds enough for a user to make an observation, but not long enough to load media. In the case of a misfeed the same process may apply, but the specified time limit may be extended from 0-30 seconds to allow more time for a user to remove the jam. This process may meet the right compromise between giving the image production device the information it requires whilst minimizing enforced customer interactions.

FIG. 1 is an exemplary diagram of an image production device 100 in accordance with one possible embodiment of the disclosure. The image production device 100 may be any device that may be capable of making image production documents (e.g., printed documents, copies, etc.) including a copier, a printer, a facsimile device, and a multi-function device (MFD), for example.

The image production device 100 may include one or more media tray doors 110 and a local user interface 120. The one or more media tray doors 110 may provide access to one or more media trays that contain media. The one or more media tray doors 110 may be opened by a user so that media may be checked, replaced, or to investigate a media misfeed or jam, for example.

The user interface 120 may contain one or more display screen (which may be a touchscreen or simply a display, for example), and a number of buttons, knobs, switches, etc. to be used by a user to control image production device 100 operations. The one or more display screen may also display warnings, alerts, instructions, and information to a user. While the user interface 120 may accept user inputs, another source of image data and instructions may include inputs from any number of computers to which the printer is connected via a network, for example.

Figure 2:
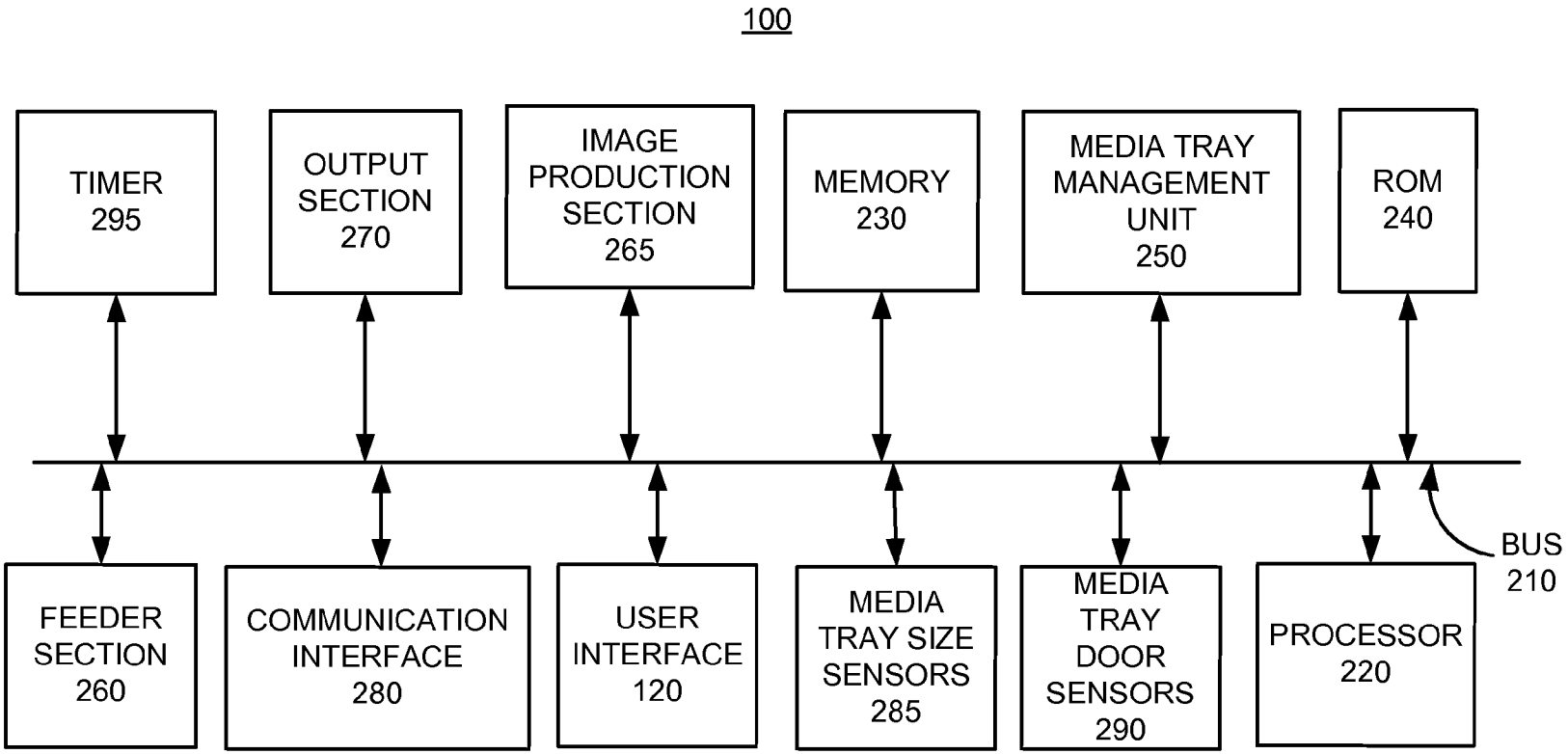
FIG. 2 is a exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM) 240, the media tray management unit 250, the user interface 120, a feeder section 260, an image production section 265, an output section 270, a communication interface 280, one or more media tray size sensors 285, one or more media tray door sensors 290, and one or more timers 295. Bus 210 may permit communication among the components of the image production device 100.

The image production section 265 may include hardware by which image signals are used to create a desired image. The stand-alone feeder section 260 may store and dispense media sheets on which images are to be printed. The output section 270 may include hardware for stacking, folding, stapling, binding, etc., prints which are output from the image production section. If the image production device 100 is also operable as a copier, the image production device 100 may further includes a document feeder and scanner which may operate to convert signals from light reflected from original hard-copy image into digital signals, which are in turn processed to create copies with the image production section 265.

With reference to feeder section 260, the section may include one or more media trays, each of which stores a media stack or print sheets ("media") of a predetermined type (size, weight, color, coating, transparency, etc.) and may include a feeder to dispense one of the media sheets therein as instructed. The media trays may be accessed by a user by opening the one or more media tray doors 110. The one or more media tray door sensors 290 may sense if one or more media tray door 290 is either open or closed. The one or more media tray door sensors 290 may be any sensors known to one of skill in the art, such as contact, infra-red, magnetic, or light-emitting diode (LED) sensors, for example. The one or more media tray size sensors 285 may be any sensors that may detect media size in a media known to one of skill in the art, including switches, etc.

The one or more timers 295 may be any type of software or hardware timer known to one of skill in the art. The one or more timers 295 may be set to a predetermined value and decremented or the one or more timers 295 may be incremented until reaching a certain predetermined value. Once one or more media tray doors 110 are opened, the one or more timers 295 are activated. One timer may be used for all media tray door 110 opening situations or events, or separate timers 295 may be used for media tray door 110 opening situations or events, for example.

Certain types of media may require special handling in order to be dispensed properly. For example, heavier or larger media may desirably be drawn from a media stack by use of an air knife, fluffer, vacuum grip or other application (not shown in the Figure) of air pressure toward the top sheet or sheets in a media stack. Certain types of coated media may be advantageously drawn from a media stack by the use of an application of heat, such as by a stream of hot air (not shown in the Figure). Sheets of media drawn from a media stack on a selected media tray may then be moved to the image production section 265 to receive one or more images thereon. Then, the printed sheet is then moved to output section 270, where it may be collated, stapled, folded, punched, etc., with other media sheets in manners familiar in the art.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 120 may include one or more conventional mechanisms that permit a user to input information to and interact with the image production device 100, such as a keyboard, a display, a mouse, a pen, a voice recognition device, touchpad, buttons, etc., for example. Output section 270 may include one or more conventional mechanisms that output image production documents to the user, including output trays, output paths, finishing section, etc., for example. The image production section 265 may include an image printing and/or copying section, a scanner, a fuser, etc., for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like that are capable of displaying the print release marking and can be scanned by the image production device.

The operation of components of the media tray management unit 250 and the media tray management process will be discussed in relation to the flowchart in FIG. 3.

Figure 3:
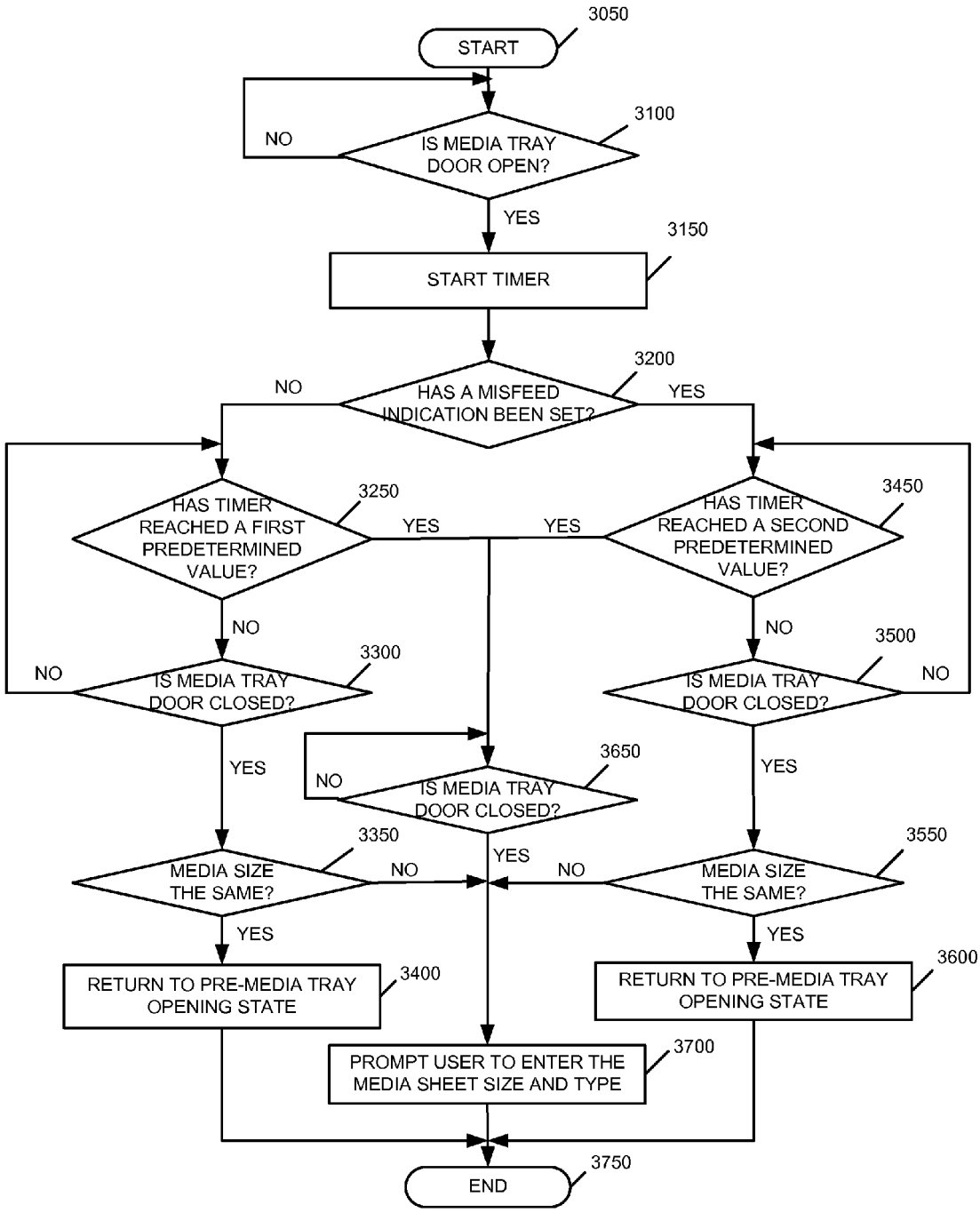
FIG. 3 is a flowchart of an exemplary media tray management process in accordance with one possible embodiment of the disclosure.

FIG. 3 is a flowchart of a media tray management process in accordance with one possible embodiment of the disclosure. The method may begin at 3050, and may continue to 3100 where the media tray management unit 250 may determine if at least one of the one or more media tray doors 110 is open. If the media tray management unit 250 determines that at least one of the one or more media tray doors 110 is not open, the process may return to step 3100.

However, if the media tray management unit 250 determines that at least one of the one or more media tray doors 110 is open, at step 3150 the media tray management unit 250 may start the timer 295. At step 3200, the media tray management unit 250 may determine if a misfeed indication has been set. A misfeed may be defined as any media misfeed, jam, etc. in any portion or section of the image production device 100. If the media tray management unit 250 determines that a misfeed indication has not been set, at step 3250 the media tray management unit 250 may determine if the timer 295 has reached a first predetermined value. The first predetermined value may be between 0 seconds and 15 seconds, for example, or set to any value that would allow the user to open and close the media tray doors 110 without replacing the media in the media trays with different size or type of media, for example.

If the media tray management unit 250 determines that the timer 295 has reached the first predetermined value, at step 3650 the media tray management unit 250 may determine if the at least one media tray door 110 has been closed. If the media tray management unit 250 determines that the at least one media tray door 110 has not been closed, the process returns to step 3650.

However, if at step 3650 the media tray management unit 250 determines that the at least one media tray door 110 has been closed, at step 3700 the media tray management unit 250 may prompt the user to enter the media sheet size and type for at least one media tray. The process may then go to step 3750 and end.

If at step 3250 the media tray management unit 250 determines that the timer 295 has not reached the first predetermined value, at step 3300 the media tray management unit 250 may determine if the at least one media tray door 110 has been closed. If the media tray management unit 250 determines that the at least one media tray door 110 has not been closed, the process may return to step 3250.

If at step 3300, the media tray management unit 250 determines that the at least one media tray door 110 has been closed, at step 3350 the media tray management unit 250 may determine if the media size in the media trays is the same or has changed by determining if one or more media tray size sensors 285 indicate a change in media size. If the media tray management unit 250 determines that the media size in the media trays has changed, at step 3700 the media tray management unit 250 may prompt the user to enter the media sheet size and type for at least one media tray. The process may then go to step 3750 and end.

If at step 3350 the media tray management unit 250 determines that the media size in the media trays is the same and has not changed, at step 3400 the media tray management unit 250 may return the image production device 100 to a pre-media tray opening state. The pre-media tray opening state may be a normal operating state, for example. The process may then go to step 3750 and end.

However, if at step 3200, the media tray management unit 250 determines that a misfeed indication has been set, at step 3450 the media tray management unit 250 may determine if the timer 295 has reached a second predetermined value. The second predetermined value may be between 0 seconds and 30 seconds, for example, or set to any value that would allow the user to open and close the media tray doors 110 without replacing the media in the media trays with different size or type of media, for example.

If the media tray management unit 250 determines that the timer 295 has reached the second predetermined value, at step 3650 the media tray management unit 250 may determine if the at least one media tray door 110 has been closed. If the media tray management unit 250 determines that the at least one media tray door 110 has not been closed, the process returns to step 3650.

However, if at step 3650 the media tray management unit 250 determines that the at least one media tray door 110 has been closed, at step 3700 the media tray management unit 250 may prompt the user to enter the media sheet size and type for at least one media tray. The process may then go to step 3750 and end.

If at step 3450 the media tray management unit 250 determines that the timer 295 has not reached the second predetermined value, at step 3500 the media tray management unit 250 may determine if the at least one media tray door 110 has been closed. If the media tray management unit 250 determines that the at least one media tray door 110 has not been closed, the process may return to step 3450.

If at step 3500, the media tray management unit 250 determines that the at least one media tray door 110 has been closed, at step 3550 the media tray management unit 250 may determine if the media size in the media trays is the same or has changed by determining if one or more media tray size sensors 285 indicate a change in media size. If the media tray management unit 250 determines that the media size in the media trays has changed, at step 3700 the media tray management unit 250 may prompt the user to enter the media sheet size and type for at least one media tray. The process may then go to step 3750 and end.

If at step 3550 the media tray management unit 250 determines that the media size in the media trays is the same and has not changed, at step 3600 the media tray management unit 250 may return the image production device 100 to a pre-media tray opening state. The pre-media tray opening state may be a normal operating state, for example. The process may then go to step 3750 and end.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for managing media trays in an image production device, comprising:

determining if a media tray door is open, the media tray door providing access to one or more media trays, wherein if it is determined that the media tray door is open;

starting a timer;

determining if a misfeed indication has been set, wherein if it is determined that a misfeed indication has not been set, determining if the timer has reached a first predetermined value, wherein if it is determined that the timer has not reached the first predetermined value, determining if the media tray door has been closed, wherein if it is determined that the media tray door has been closed, determining if the media size of media in the one or more media trays is the same as the size of the media before the media tray door was opened, wherein if it is determined that the media size of media in the one or more media trays is the same, returning the image production device to a pre-media tray door opening state, otherwise if it is determined that a misfeed indication has been set, determining if the timer has reached a second predetermined value, wherein if it is determined that the timer has not reached the second predetermined value, determining if the media tray door has been closed, wherein if it is determined that the media tray door has been closed, determining if the media size of media in the one or more media trays is the same as the size of the media before the media tray door was opened, wherein if it is determined that the media size of media in the one or more media trays is the same, returning the image production device to the pre-media tray door opening state.

2. The method of claim 1, wherein if it is determined that a misfeed indication has not been set and the timer reaches the first predetermined value before the media tray door is closed, further comprising:

determining if the media tray door has been closed, wherein if it is determined that the media tray door has been closed, prompting the user to enter a media sheet size and media type for at least one media tray.

3. The method of claim 1, wherein if it is determined that a misfeed indication has been set and the timer reaches the second predetermined value before the media tray door is closed, further comprising:

determining if the media tray door has been closed, wherein if it is determined that the media tray door has been closed, prompting the user to enter a media sheet size and media type for at least one media tray.

4. The method of claim 1, wherein the first predetermined value is between 0 seconds and 15 seconds.

5. The method of claim 1, wherein the second predetermined value is between 0 seconds and 30 seconds.

6. The method of claim 1, wherein the timer is one of incremented and decremented.

7. The method of claim 1, wherein the image production device is one of a copier, a printer, a facsimile device, and a multi-function device.

8. An image production device, comprising:

one or more media tray doors that provide access to one or more respective media trays and may be opened by a user;

one or more media tray door sensors that sense whether one or more media tray doors is at least one of open and closed;

one or more respective media tray size sensors that sense media size in a one or more media tray(s);

a timer associated with each of the one or more media tray doors respectively; and a media tray management unit that determines if at least one of the one or more media tray doors is open, wherein if the media tray management unit determines that at least one of the one or more media tray doors is open, the media tray management unit starts the timer, determines if a misfeed indication has been set, wherein if the media tray management unit determines that a misfeed indication has not been set, the media tray management unit determines if a respective timer associated with the open door has reached a first predetermined value, wherein if the media tray management unit determines that the respective timer has not reached the first predetermined value, the media tray management unit determines if the at least one media tray door has been closed, wherein if the media tray management unit determines that the at least one media tray door has been closed, the media tray management unit determines if the media size of media in the one or more media trays is the same, wherein if the media tray management unit determines that the media size of media in the one or more media trays is the same as the size of the media before the media tray door was opened, the media tray management unit returns the image production device to a pre-media tray door opening state, otherwise if the media tray management unit determines that a misfeed indication has been set, the media tray management unit determines if the respective timer has reached a second predetermined value, wherein if the media tray management unit determines that the timer has not reached the second predetermined value, the media tray management unit determines if the at least one media tray door has been closed, wherein if the media tray management unit determines that the at least one media tray door has been closed, the media tray management unit determines if the media size of media in the one or more media trays associated with the door that had been open is the same as the size of the media before the media tray door was opened, wherein if the media tray management unit determines that the media size of media in the one or more media trays associated with the door that had been open is the same, the media tray management unit returns the image production device to the pre-media tray door opening state.

9. The image production device of claim 8, wherein if the media tray management unit determines that a misfeed indication has not been set and the respective timer reaches the first predetermined value before the at least one media tray door is closed, the media tray management unit determines if the at least one media tray door has been closed, wherein if the media tray management unit determines that the at least one media tray door has been closed, the media tray management unit prompts the user to enter a media sheet size and media type for at least one media tray associated with the door that had been open.

10. The image production device of claim 8, wherein if the media tray management unit determines that a misfeed indication has been set and the respective timer reaches the second predetermined value before the at least one media tray door is closed, the media tray management unit determines if the at least one media tray door has been closed, wherein if the media tray management unit determines that the at least one media tray door has been closed, the media tray management unit prompts the user to enter a media sheet size and media type for at least one media tray associated with the door that had been open.

11. The image production device of claim 8, wherein the first predetermined value is between 0 seconds and 15 seconds.

12. The image production device of claim 8, wherein the second predetermined value is between 0 seconds and 30 seconds.

13. The image production device of claim 8, wherein the respective timer is one of incremented and decremented.

14. The image production device of claim 8, wherein the image production device is one of a copier, a printer, a facsimile device, and a multi-function device.

15. A non-transitory computer-readable medium storing instructions for controlling a computing device for managing media trays in an image production device, the instructions comprising:

determining if a media tray door is open, the media tray door providing access to one or more media trays, wherein if it is determined that the media tray door is open;

starting a timer;

determining if a misfeed indication has been set, wherein if it is determined that a misfeed indication has not been set, determining if the timer has reached a first predetermined value, wherein if it is determined that the timer has not reached the first predetermined value, determining if the media tray door has been closed, wherein if it is determined that the media tray door has been closed, determining if the media size of media in one of the one or more media trays is the same as the size of the media before the media tray door was opened, wherein if it is determined that the media size of media in one of the one or more media trays is the same, returning the image production device to a pre-media tray door opening state, otherwise if it is determined that a misfeed indication has been set, determining if the timer has reached a second predetermined value, wherein if it is determined that the timer has not reached the second predetermined value, determining if the media tray door has been closed, wherein if it is determined that the media tray door has been closed, determining if the media size of media in the one or more media trays is the same as the size of the media before the media tray door was opened, wherein if it is determined that the media size of media in the one or more media trays is the same, returning the image production device to the pre-media tray door opening state.

16. The non-transitory computer-readable medium of claim 15, wherein if it is determined that a misfeed indication has not been set and the timer reaches the first predetermined value before the media tray door is closed, further comprising: determining if the media tray door has been closed, wherein if it is determined that the media tray door has been closed, prompting the user to enter a media sheet size and media type for at least one media tray.

17. The non-transitory computer-readable medium of claim 15, wherein if it is determined that a misfeed indication has been set and the timer reaches the second predetermined value before the media tray door is closed, further comprising: determining if the media tray door has been closed, wherein if it is determined that the media tray door has been closed, prompting the user to enter a media sheet size and media type for at least one media tray.

18. The non-transitory computer-readable medium of claim 15, wherein the first predetermined value is between 0 seconds and 15 seconds.

19. The non-transitory computer-readable medium of claim 15, wherein the second predetermined value is between 0 seconds and 30 seconds.

20. The non-transitory computer-readable medium of claim 15, wherein the timer is one of incremented and decremented.

21. The computer-readable medium of claim 15, wherein the image production device is one of a copier, a printer, a facsimile device, and multi-function device.

* * * * *